US006923400B2

(12) United States Patent
Mausser et al.

(10) Patent No.: US 6,923,400 B2
(45) **Date of Patent: *Aug. 2, 2005**

(54) PROCESS AND DEVICE FOR CONTINUOUS REELING OF A PULP SHEET

(75) Inventors: Wilhelm Mausser, Graz (AT); Gerald Schadler, Vasoldsberg (AT)

(73) Assignee: Andritz AG, Graz (AT)

( * ) Notice: Subject to any disclaimer, the term of this patent is extended or adjusted under 35 U.S.C. 154(b) by 0 days.

This patent is subject to a terminal disclaimer.

(21) Appl. No.: 10/047,622

(22) Filed: Jan. 16, 2002

(65) Prior Publication Data

US 2002/0100571 A1 Aug. 1, 2002

(30) Foreign Application Priority Data

Jan. 22, 2001 (AT) ..... A 104/2001

(51) Int. Cl.[7] ..... B65H 18/14

(52) U.S. Cl. ..... 242/541.1; 242/541.7; 242/542.3

(58) Field of Search ..... 242/541.1, 541.7, 242/542.3, 539

(56) References Cited

U.S. PATENT DOCUMENTS

| | | | | | |
|---|---|---|---|---|---|
| 3,687,388 | A | * | 8/1972 | Pfeiffer | 242/534 |
| 3,877,654 | A | * | 4/1975 | Randpalu et al. | 242/533.1 |
| 5,611,500 | A | * | 3/1997 | Smith | 242/541.4 |
| 5,664,737 | A | * | 9/1997 | Johnson et al. | 242/541.1 |
| 5,845,868 | A | * | 12/1998 | Klerelid et al. | 242/541 |
| 6,029,927 | A | * | 2/2000 | Wohlfahrt et al. | 242/527.2 |
| 6,036,137 | A | * | 3/2000 | Myren | 242/541.7 |
| 6,250,580 | B1 | * | 6/2001 | Madrzak et al. | 242/533.2 |

* cited by examiner

*Primary Examiner*—Kathy Matecki
*Assistant Examiner*—Sang Kim
(74) *Attorney, Agent, or Firm*—Alix, Yale & Ristas, LLP

(57) ABSTRACT

A process for continuous reeling of a pulp sheet, particularly a paper sheet, where the sheet runs over a reel drum and is later wound on a winding unit. The pressing force in the nip between the horizontal reel and the reel drum being measured without any losses during the entire winding process. This process is implemented by a device having a reel drum and a horizontal reel supported on load-sensing devices.

5 Claims, 3 Drawing Sheets

PROCESS AND DEVICE FOR CONTINUOUS REELING OF A PULP SHEET

BACKGROUND OF THE INVENTION

The invention relates to a process and a device for continuous reeling of a pulp sheet, particularly a paper sheet, e.g. tissue, where the sheet runs over a reel drum and is later wound on a winding unit.

Processes and devices of this kind have been known for some time in the production of paper sheet. The disadvantage of the devices known is that either the contact pressure of the horizontal reel on the reel drum is such that the horizontal reel is driven by the force generated by friction, or a separate drive is provided for the horizontal reel, where the pressing force cannot be set exactly because there are too many points where non-calculable losses arise, e.g. due to friction. The pressure pre-set at the contact pressure cylinders thus does not define the actual pressing force between reel drum and horizontal reel. Low pressing force is desirable in particular for tissue with a high volume in order to avoid destroying the high volume again with the contact pressure. In the conventional devices known, however, the pressing force can only be set imprecisely and the losses due to friction in the mechanical parts already exceed the required contact pressure, thus it is impossible to control the pressing force exactly. As a result of the uneven pressing forces in the primary arm and secondary arm, the quality of the paper in the conventional equipment cannot be maintained at a constant level and the beginning of the sheet usually has to be recycled as broke.

SUMMARY OF THE INVENTION

The aim of the invention is to propose a process and a device that are easy to control during the entire winding process, even at low contact pressures.

The invention is thus characterized by the pressing force in the nip between the horizontal reel (core shaft) and reel drum being measured without any losses during the entire winding process. Since the measurement is taken without any losses, the contact pressure can always be determined exactly and adjusted continuously. This applies in particular to the transfer from primary arm to secondary arm.

An advantageous further development of the invention is characterized by the reading measured for the pressing force being used to control the pressing force at a desired level. Thus, it is also possible to set a low pressing force.

An advantageous configuration of the invention is characterized by the pressing force and the regulating distance being controlled by a measuring system integrated into the pressure cylinders that generate the contact pressure.

A favorable further development of the invention is characterized by the compressive force being adapted continuously to the changing pressing force. As a result, it is possible to achieve a low pressing force and, in consequence thereof, maintain the volume, particularly with high-volume tissue paper.

The invention also refers to a device for implementing the process, with a reel drum and a horizontal reel, characterized by the horizontal reel in the primary arm being supported on load-sensing devices. As a result, it is possible to measure the contact pressure directly and without any losses, while guaranteeing uniform paper quality right through the entire reeling process.

An advantageous further development of the invention is characterized by the horizontal reel being supported on movable bearings, by means of roller bearings and cylinders. This permits continuous adapting of the pressing force being guaranteed throughout the entire winding process.

A favorable configuration of the invention is characterized by the load-sensing device being integrated into the cylinder. This permits a compact design for the primary arm.

A favorable further development of the invention is characterized by the horizontal reel being supported on load-sensing devices in a horizontally adjustable holding device. With this combination of load-sensing devices in the primary arm and secondary arm (adjustable holding device) a constant pressing force is guaranteed by the horizontal reel on the reel drum during the entire winding procedure. This then results in a constant paper quality right from the beginning of winding. Thus, the broke can be reduced to a minimum (e.g. glued seams).

BRIEF DESCRIPTION OF THE DRAWINGS

The invention will now be described in examples and referring to the drawings, where.

DETAILED DESCRIPTION OF THE PREFERRED EMBODIMENT

Figure 1:
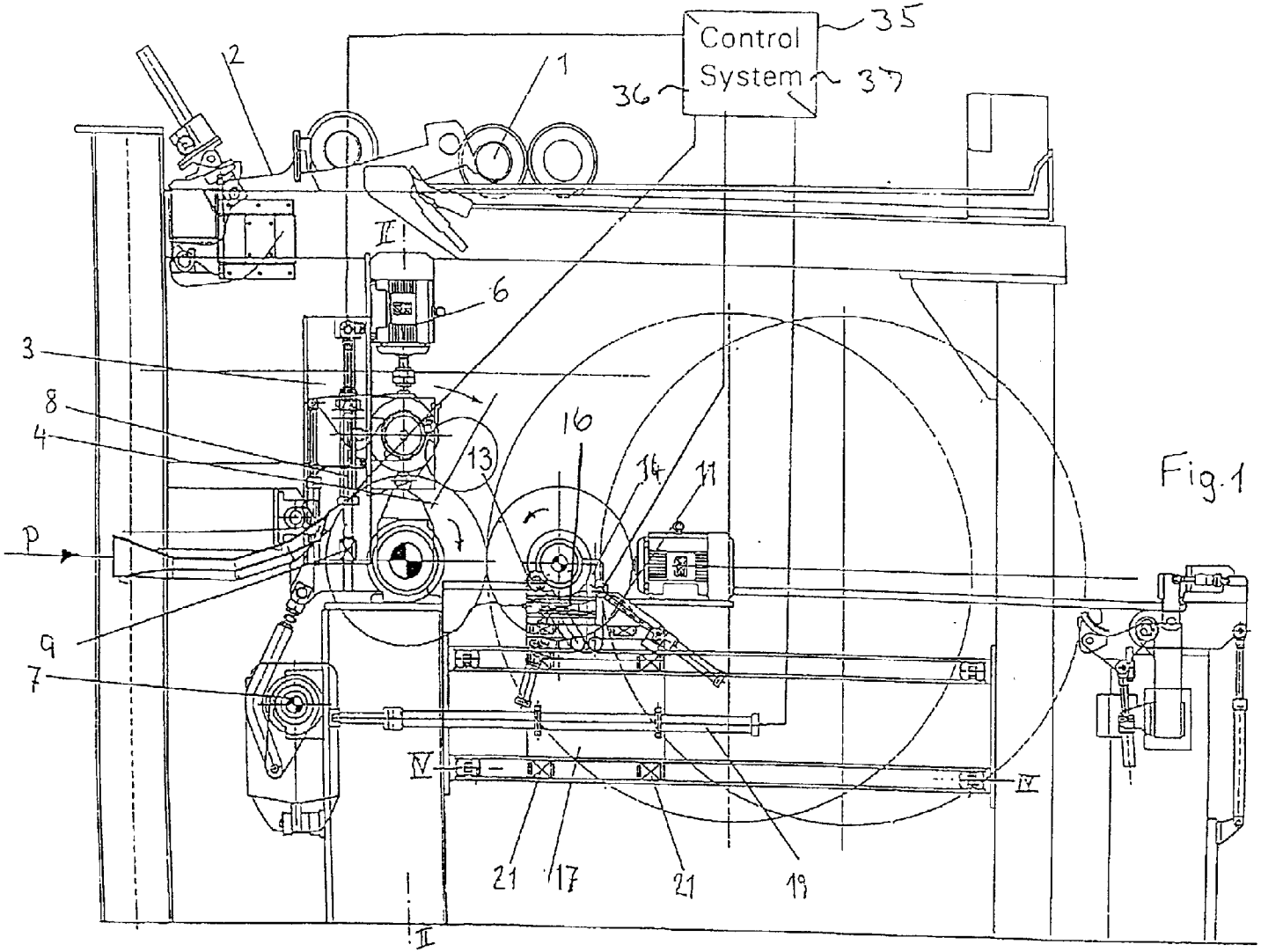
FIG. 1 shows a plant according to the invention, FIG. 2 contains an extract from FIG. 1.

The action of the device will now be described with the help of FIG. 1. The core shaft (horizontal reel) 1 is placed in the primary arm 3 using a lowering device 2 and clamped in place hydraulically in a vertical position above the reel drum 4. On the front side, FS, there is a gear motor 6 installed on a mounting plate and which is movable in axial direction. This motor is coupled to the core shaft 1 to bring the shaft up to machine speed.

A swiveling device 7 now turns the primary arm 3 round the axis of the reel drum 4 until the core shaft 1 is resting on the drum. During this process the core shaft 1 takes hold of the paper web P over its entire width with the aid of a suitable device and begins winding it on, thus increasing its diameter. The pressing force needed between the core shaft 1 and the reel drum 4 is applied and controlled via hydraulic cylinders 8, which are fitted with a load-sensing device 10. Here, compensation of the weight of the core shaft 1 is also taken into account. The primary arm 3 is now swiveled further round the axis of the reel drum 4 until the core shaft 1 reaches a horizontal position. At the same time, the thickness of the paper roll increases continuously up to a maximum of 350 mm. During this process, the outer part of the primary arm 3 moves outwards telescopically. This arm runs on roller bearings 9 in order to keep the influence of friction on the nip force as low as possible. The paper roll is placed on a horizontally movable holding device 11 and clamped in. The holding device 11 comprises a receiving part 12 with two hydraulically operated clamping levers 13, 14 and rests on a load-sensing device 16, which again is mounted on the movable part 17. The entire unit is also referred to as the secondary arm. On the rear side there is a gear motor that is movable in axial direction connected to the holding device 11. As soon as the paper roll is horizontal, this drive on the rear side is connected to the core shaft 1 and the drive 6 in the primary arm 3 is disconnected. In the further winding process the horizontal nip force A (pressing force between horizontal reel 1 and reel drum 4) is generated via the secondary arm with one hydraulic cylinder 19 on both the front side and rear side and controlled using load-sensing devices 16.

As the winding process continues in the secondary arm, the next core shaft 1 is prepared in the primary arm 3. As soon as the paper reel has obtained the desired size, it is pulled away from the reel drum 4, the new core shaft 1 in the primary arm 3 is placed in the initial winding position on the reel drum 4 and the full width of the paper web P is now wound onto this new core shaft. When the finished paper roll has been ejected from the secondary arm, this arm moves back to the reel drum 4 and then receives the new core shaft 1 from the primary arm 3. The load-sensing devices 16 are designed such that they only measure the horizontal forces actually applied in the nip between the horizontal reel 1 and the reel drum 4. Vertical components from the drives or from the changing own weight of the paper roll do not influence the values measured. The measured value signals recorded control the movement of the two hydraulic cylinders 19 in order to ensure that the secondary arms are running absolutely parallel on the front and rear sides, and to guarantee a pre-selected nip force progression (constant or changing) through the entire winding process. The moving part 17 of the secondary arm is supported on horizontal rollers 21 in order to keep the influence of friction low here as well.

Figure 2:
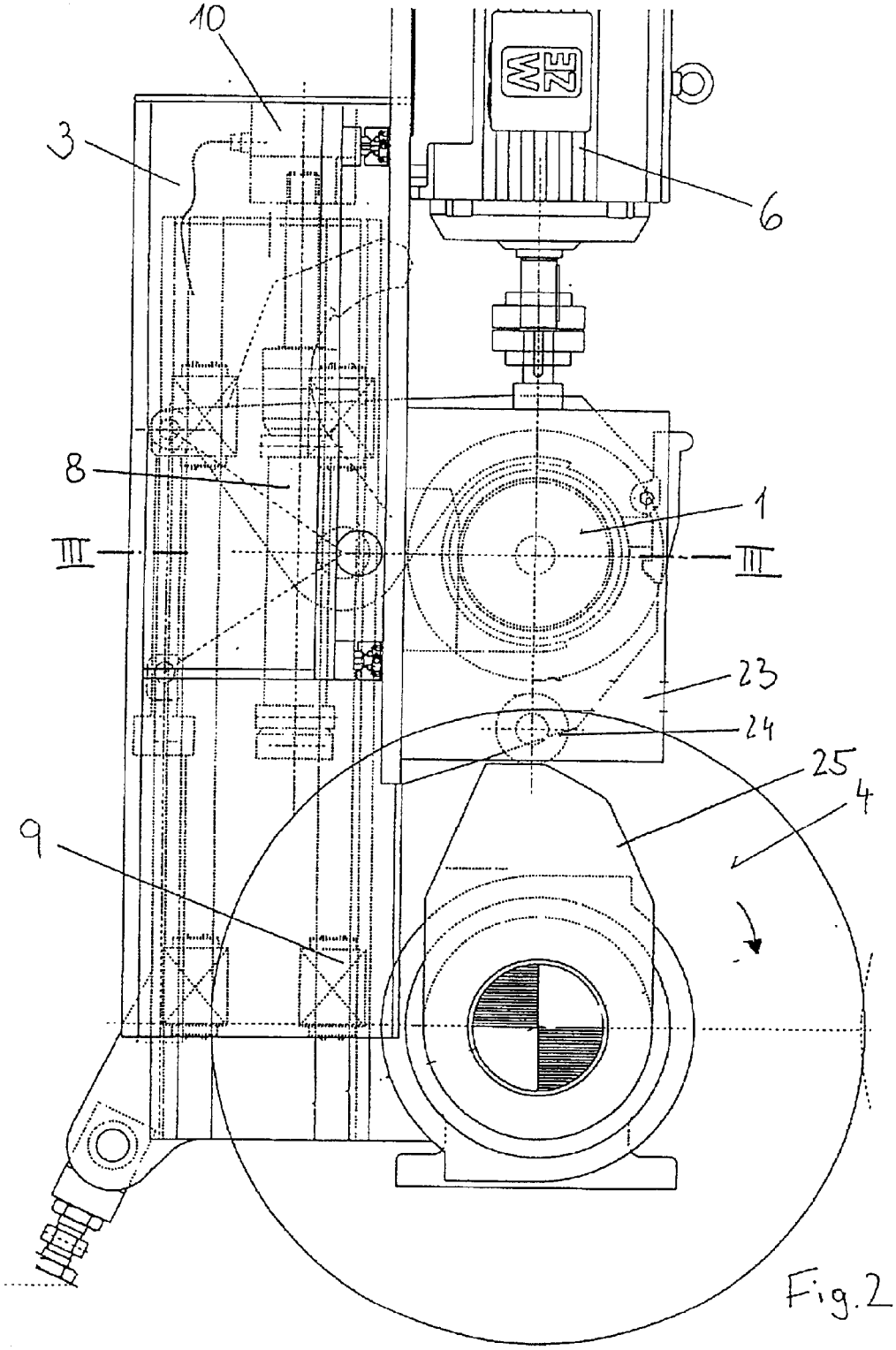

FIG. 2 shows an extract from FIG. 1, illustrating the primary arm 3. This figure shows the position of the core shaft (horizontal reel) 1 in which the drive 6 receives the core shaft. During the winding process the entire primary arm is swiveled in the rotating direction of the reel drum 4. When this happens, the core shaft 1 in the sliding block 23 rolls with the aid of a roller 24 through along a the outer edge of a guide plate 25, thus coming closer to the surface of the reel drum 4. The moment the core shaft 1 comes into contact with the reel drum 4, the paper is torn off and immediately wound onto the core shaft 1 rotating at the same speed as the reel drum 4. The pressing force of the core shaft 1 on the reel drum 4 and also the regulating distance of the cylinder 8 are measured and regulated continuously by the load-sensing device 10 according to the given settings. Since the primary arm is supported in roller bearings 9, movement of this arm without losses is guaranteed, as is continuous adjusting of the contact pressure, even at very low pressing forces (down to at least 0.1 N/mm). The winding process continues until the horizontal position is reached. Here the core shaft 1 is transferred to the load-sensing devices 16 in the holding device 11 so that the horizontal reel 1 is supported on load-sensing devices through the entire winding process. Thus, it is possible to guarantee even paper quality throughout the entire winding process. This is particularly important for high-volume tissue grades.

Figure 3:
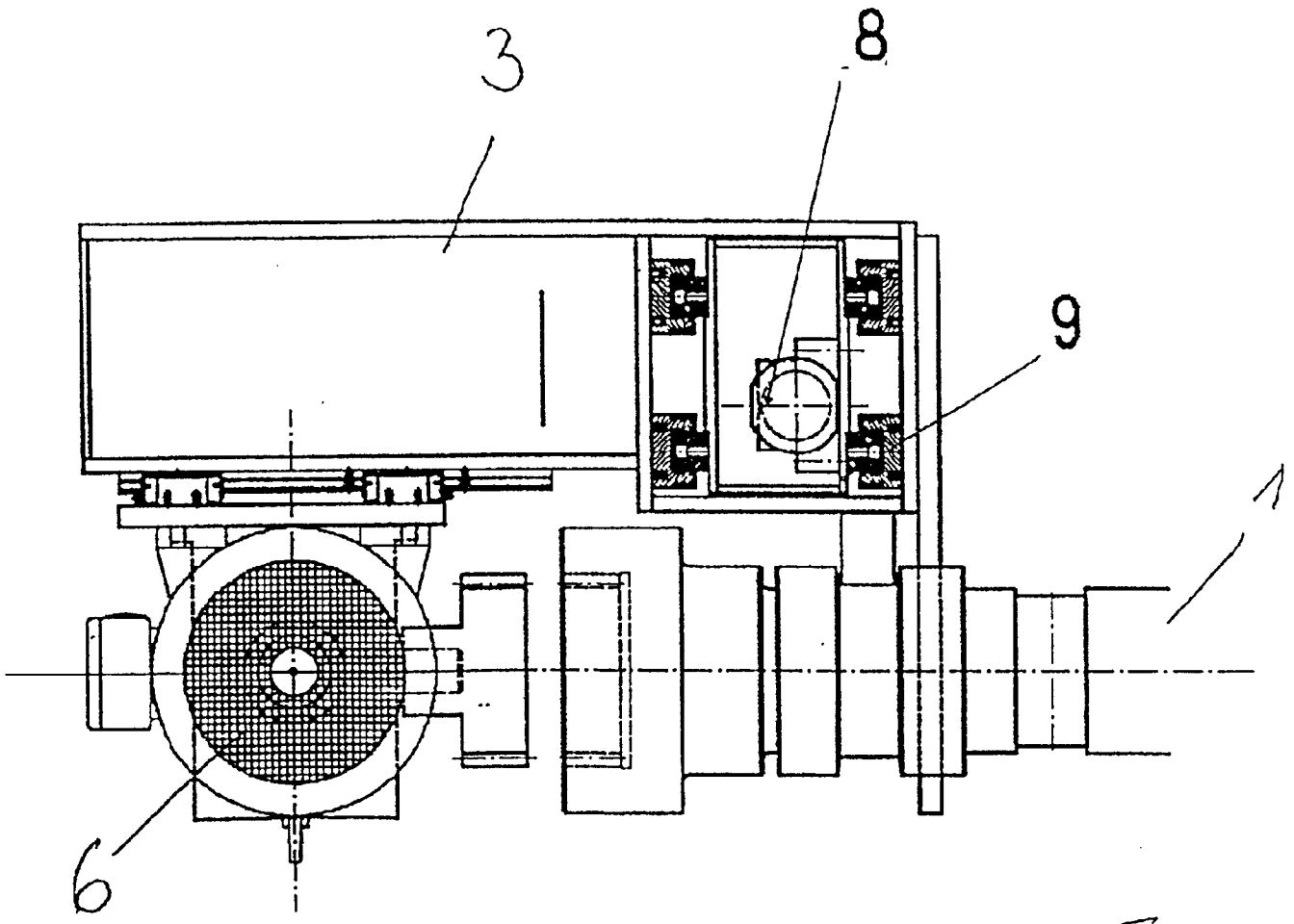
FIG. 3 shows a sectional view taken along the line III—III in FIG. 2.

FIG. 3 shows a sectional view taken along the line III—III in FIG. 2. This illustration clearly shows how the primary arm 3 is supported on roller bearings 9, as well as the pressure cylinder 8 that makes the telescopic movement.

It should be appreciated that the control system 35 preferably includes two circuits 36, 37. The first circuit 36 connects the sensing device 10 in the primary arm 3 with the respective pressure cylinder(s) 8. The second circuit 37 connects the sensing device 16 in the secondary arm with the pressure cylinder(s) 19. Since the pressure force should be constant also between the primary and secondary arms both circuits 36, 37 are preferably connected in the same control system 35.

What is claimed is:

1. Process for continuous reeling of a pulp sheet, comprising the steps of:

clamping a horizontal reel on a primary arm in a substantially vertical position above a reel drum;

swiveling the primary arm around an axis of the reel drum until the horizontal reel is in a substantially horizontal position and resting on the reel drum, while swiveling the primary arm running the pulp sheet over the reel drum;

winding the pulp sheet on a core shaft of the horizontal reel;

pressing the pulp sheet in a nip between the horizontal reel and the reel drum;

measuring the value of the pressure force in the nip directly with a load sensing device disposed below the core shaft, whereby frictional losses associated with other process components are eliminated; and controlling the pressure force in the nip at a desired level, using only the measured value of the pressure force, during the entire winding process from the moment of taking over the pulp sheet onto the core shaft of the horizontal reel until the horizontal reel is pulled away from the reel drum.

2. Process according to claim 1 further comprising the step of controlling the pressure force with a pressure cylinder.

3. Process according to claim 2 further comprising the step of adapting the pressure force continuously.

4. Apparatus for continuously reeling a pulp sheet, comprising:

a horizontal reel for having the pulp sheet wound thereon;

a reel drum for pressing the pulp sheet onto the horizontal reel; and a primary arm including a load sensing device, a plurality of roller bearings, and a hydraulic cylinder supported on the roller bearings, the load-sensing device being integrated into the hydraulic cylinder, and the horizontal reel and the pulp sheet wound thereon being biased toward the reel drum by the hydraulic cylinder and the load sensing device as the horizontal reel is swiveled by the primary arm from a substantially vertical position above the reel drum to a substantially horizontal position and resting on the reel drum, while swiveling the primary arm.

5. Apparatus according to claim 4 further comprising a secondary arm including a horizontally adjustable holding device having a load sensing device, the horizontal reel being supported on the load-sensing device of the horizontally adjustable holding device.

* * * * *